US008692818B2

(12) United States Patent
Chae et al.

(10) Patent No.: US 8,692,818 B2
(45) Date of Patent: Apr. 8, 2014

(54) DRIVING DEVICE FOR DISPLAY AND DISPLAY USING THE SAME AND DRIVING METHOD OF THE DISPLAY

(75) Inventors: Se-Byung Chae, Seoul (KR); Bo-Young An, Seoul (KR); Joo-Hyung Lee, Seoul (KR); Soon-Dong Kim, Pyeongtaek-si (KR); Ho-Suk Maeng, Seoul (KR); Seung-Bin Moon, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 632 days.

(21) Appl. No.: 12/486,809

(22) Filed: Jun. 18, 2009

(65) Prior Publication Data

US 2010/0156864 A1 Jun. 24, 2010

(30) Foreign Application Priority Data

Dec. 24, 2008 (KR) ..... 10-2008-0133711

(51) Int. Cl.
*G09G 5/00* (2006.01)
*G09G 3/30* (2006.01)

(52) U.S. Cl.
USPC ..... 345/207; 345/77

(58) Field of Classification Search
None
See application file for complete search history.

(56) References Cited

U.S. PATENT DOCUMENTS 7,202,458 B2 * 4/2007 Park ..... 250/205
7,260,422 B2 8/2007 Knoedgen
2004/0032676 A1 2/2004 Drummond et al.
2004/0227719 A1 * 11/2004 Chang et al. ..... 345/102
2007/0046619 A1 3/2007 Sano et al.
2007/0120806 A1 * 5/2007 Schmidt et al. ..... 345/102

(Continued)

FOREIGN PATENT DOCUMENTS

CN 101029983 9/2007
CN 101305414 11/2008

(Continued)

OTHER PUBLICATIONS

Texas_Instruments_Burr-Brown_Photodiode_Circuits_sboa061, dated Jan. 1994.*

(Continued)

*Primary Examiner* — Alexander S Beck
*Assistant Examiner* — Ibrahim Khan
(74) *Attorney, Agent, or Firm* — F. Chau & Associates, LLC

(57) ABSTRACT

A driving device for a display and a display using same, and a driving method of the display are provided. The display includes a display panel on which an image is displayed, and at least one optical sensor (photodetector) to detect the intensity of ambient (external) light incident upon the display panel. An external-brightness detector outputs an external-brightness signal based on the intensity of external (ambient) light and a backlight brightness controller changes the brightness of the image displayed (or backlight) on the display panel according to the external-brightness signal. The driving device may be implemented on an integrated circuit adapted to be connected to external-light photodetectors of type 1 or of type 2. The driving device may be may be dynamically configured to generate the external-brightness signal by sensing a voltage level of the light detecting node in a first mode of operation and may be reconfigured to generate the external-brightness signal by sensing a current level of the light detecting node in a second mode.

22 Claims, 11 Drawing Sheets

(56) References Cited

U.S. PATENT DOCUMENTS

| | | | | |
|---|---|---|---|---|
| 2007/0171182 | A1 | 7/2007 | Mizuno et al. | |
| 2008/0001876 | A1* | 1/2008 | Ito et al. | 345/87 |
| 2008/0149811 | A1 | 6/2008 | Kim | |

FOREIGN PATENT DOCUMENTS

| | | |
|---|---|---|
| EP | 1950731 | 7/2008 |
| JP | 9298690 | 11/1997 |
| JP | 2006-243655 | 9/2006 |
| JP | 2007-273934 | 10/2007 |
| KR | 1020060133165 | 12/2006 |
| WO | 2008143216 | 11/2008 |

OTHER PUBLICATIONS

European Office Action dated Nov. 12, 2010 in corresponding European Appln. No. 09009742.9-1228.

Japanese Office Action dated Sep. 3, 2013 issued by the Japanese Patent Office for related Japanese Patent Appln. No. 2009-186048.

Chinese Office Action dated Jun. 5, 2013 issued by SIPO for related Chinese Patent Application No. 200910222730.5.

* cited by examiner

DRIVING DEVICE FOR DISPLAY AND DISPLAY USING THE SAME AND DRIVING METHOD OF THE DISPLAY

CROSS-REFERENCE TO RELATED APPLICATION

This application claims priority, under 35 U.S.C. §119, of Korean Patent Application No. 10-2008-0133711 filed on Dec. 24, 2008 in the Korean Intellectual Property Office, which is incorporated by reference herein in its entirety.

BACKGROUND OF THE INVENTION

1. Field of the Invention

The present invention relates to a driving device for a display and a display using the same, and a driving method of the display.

2. Description of the Related Art

In recent years, various types of flat panel displays have been developed to replace cathode ray tube (CRT) displays. Examples of flat panel display types include the organic light emitting diode display (OLED), the plasma display panel (PDP), the liquid crystal display (LCD), and the surface-conduction electron-emitter display (SED).

An LCD generally includes a liquid crystal panel composed of a first transparent substrate provided with pixel electrodes, a second transparent substrate provided with a common electrode, and a layer of liquid crystal molecules having dielectric anisotropy interposed between the first and second transparent substrates. An electric field is generated between the pixel electrode and the common electrode in each pixel and the intensity of the electric field is adjusted according to image data, thereby controlling the amount of light transmitted through each pixel of the liquid crystal panel and displaying a desired image. Since the LCD panel cannot generate and emit light by itself, a backlight unit for supplying the liquid crystal panel with light is provided behind the liquid crystal panel.

In order to reduce power consumption of a backlight unit, technology for controlling the brightness of the back light according to image data has recently been developed.

SUMMARY OF THE INVENTION

An aspect of the present invention provides a display having the brightness of an image displayed thereon controlled according to the ambient (external) light detected. The display according to embodiments of the present invention can control the brightness of the image displayed on the display panel (specifically, the brightness of the back light) according to the brightness of external (ambient) light. For example, if the external light is dark, the brightness of back light is decreased, and if the external light is bright, the brightness of back light is increased. Therefore, the display according to embodiments of the present invention can improve the viewing quality of an image displayed while reducing power consumed by the display.

Another aspect of the present invention provides a driving device for a display of controlling the brightness of an image displayed according to the light detected.

Another aspect of the present invention provides a method of driving a display including controlling the brightness of an image displayed according to the light detected by either voltage-mode photodetectors or current-mode photodetectors incorporated within the display.

According to an aspect of the present invention, there is provided a display including a display panel on which an image is displayed, a photodetector detecting light, an external-brightness detector outputting an external-brightness signal by sensing a light detecting node, the external-brightness detector outputting the external-brightness signal based on sensing a voltage level of the light detecting node while operating in a first mode while a photodetector connected to the light detecting node is a voltage-mode photodetector and based on sensing a current level of the light detecting node while operating in a second mode while a photodetector connected to the light detecting node is a current-mode photodetector, and a brightness controller controlling the brightness of the image displayed on the display panel according to the external-brightness signal.

According to another aspect of the present invention, there is provided a driving device of a display, the driving device including an external-brightness detector outputting an external-brightness signal based on sensing a light detecting node ;a first read circuit selectively connected directly to the light detecting node in the first mode while a photodetector connected to the light detecting node is a voltage-mode photodetector that reads the external light by sensing the voltage level of the light detecting node; and a second read circuit selectively enabled in the second mode while a photodetector connected to the light detecting node is a current-mode photodetector that reads the light by sensing the current level of the light detecting node; and an external-brightness signal generator generating the external-brightness signal based on a result output from the read circuit, and a brightness controller controlling the brightness of an image displayed on a display panel according to the external-brightness signal.

According to still another aspect of the present invention, there is provided a driving method of a display, the driving method including:

generating an external-brightness signal based on sensing a voltage level of a light detecting node connected to a voltage-mode photodetector while operating in a first mode; and generating an external-brightness signal based on sensing a current level of a light detecting node connected to a current-mode photodetector while operating in a second mode, and controlling the brightness of an image displayed on a display panel according to the external-brightness signal.

Features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these exemplary embodiments are provided so that this disclosure will be thorough and complete and will fully convey the concept of the invention to those skilled in the art, and the present invention will only be defined by the appended claims. Like reference numerals refer to like elements throughout the specification.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items.

It will be understood that, although the terms first, second, etc. may be used herein to describe various elements, circuits, components, regions, and/or sections, these elements, circuits, components, regions, and/or sections should not be limited by these terms. These terms are only used to distinguish one element, component, region, or section from another region, or section unless context clearly indicates otherwise. Thus, a first element, component, region, or section discussed below could be termed a second element, component, region, or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS OF THE INVENTION

Figure 1:
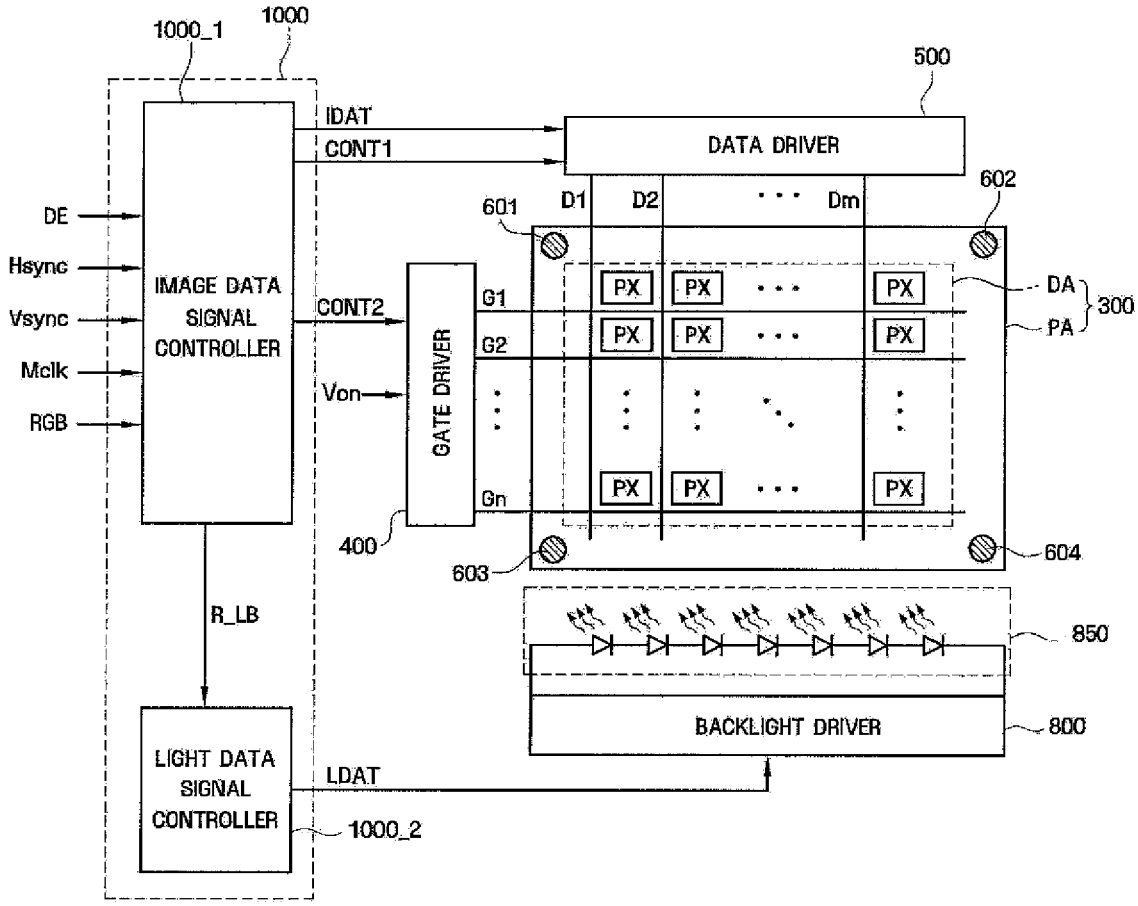
FIG. 1 is a circuit block diagram of a display according to an exemplary embodiment of the present invention.
Figure 2:
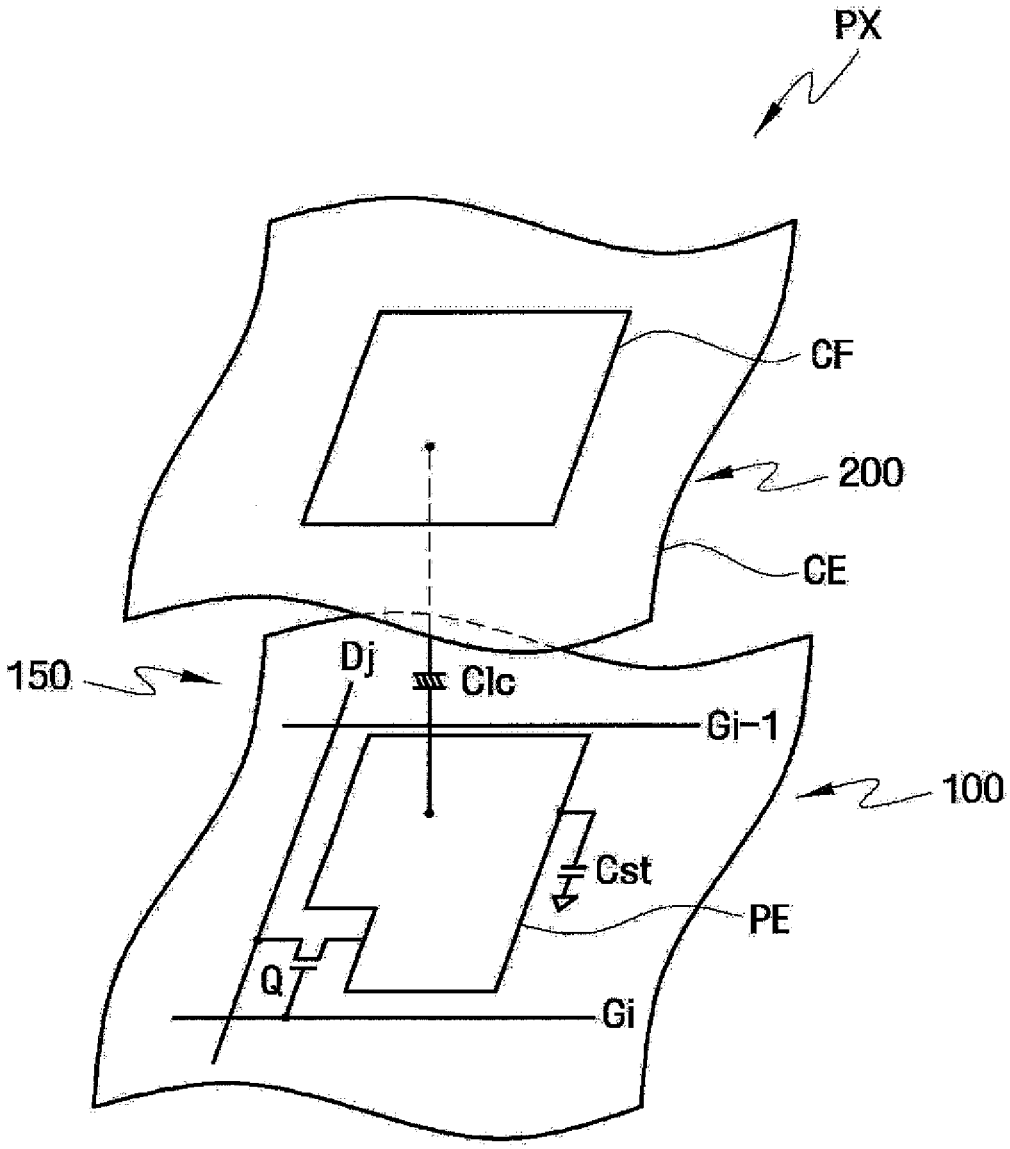
FIG. 2 is an equivalent circuit diagram of an LCD pixel in the display panel in the display of FIG. 1.

FIG. 1 is a circuit block diagram of a display according to an exemplary embodiment of the present invention, and FIG. 2 is an equivalent circuit diagram of a pixel shown in FIG. 1.

For the convenience of explanation, an exemplary display panel according to the present invention including four (4) voltage-mode photodetectors will now be described. However, the present invention is not limited thereto.

Referring to FIGS. 1 and 2, a display according to an exemplary embodiment of the present invention may include a display panel 300, a signal controller 1000, a gate driver 400, a data driver 500, a backlight driver 800, and a light-emitting block 850.

The display panel 300 includes a plurality of gate lines G1-Gn, a plurality of data lines D1-Dm, and a plurality of pixels PX, and is divided into a display area DA including the pixels PX that display images, and a peripheral area PA where no image is displayed.

The display panel 300 includes a first substrate 100 having a plurality of gate lines G1-Gn, a plurality of data lines D1-Dm, and in each pixel, a switching element Q, and a pixel electrode PE. The display panel 300 further includes a second substrate 200 having a color filter CF and a common electrode CE, and a liquid crystal layer 150 interposed between the first and second substrates 100 and 200. The plurality of gate lines G1-Gn extend in a row direction and are parallel to each other, and the plurality of data lines D1-Dm extend in a column direction and are parallel to each other.

An equivalent circuit of each pixel PX is described with reference to FIG. 2. The color filter CF of each pixel PX is formed on a portion of the common electrode CE opposite the pixel electrode PE on the first substrate 100. For example, a pixel PX connected to an i-th gate line Gi (where i is one of 1 through n) and a j-th data line Dm (where j is one of 1 through m) includes a switching element Q connected to the gate line Gi and to the data line Dm, a liquid crystal capacitor Clc, and a storage capacitor Cst connected thereto.

The storage capacitor Cst may be omitted in some alternative embodiments. Although FIG. 2 shows that the color filter CF is formed in the second substrate 200 having the common electrode CE, the invention is not limited to the illustrated example, and the color filter CF may be formed in the first substrate 100.

The peripheral area PA may be an area where the first substrate 100 is wider than the second substrate 200 where an image is not displayed. Accordingly, the photodetectors 601-604 (see FIG. 5) may be mounted in the peripheral area PA to detect light and to provide the detected light signals to the light data signal controller 1000_2.

The signal controller 1000 receives raw image signals RGB, input control signals for controlling the display thereof, and detected-light signals detected from photodetectors 601-604, and outputs converted image data signals IDAT, a data control signal CONT1, a gate control signal CONT2 and a light data signal LDAT. The signal controller 1000 may include an image data signal controller 1000_1 and a light data signal controller 1000_2, as shown in FIG. 1.

Figure 3:
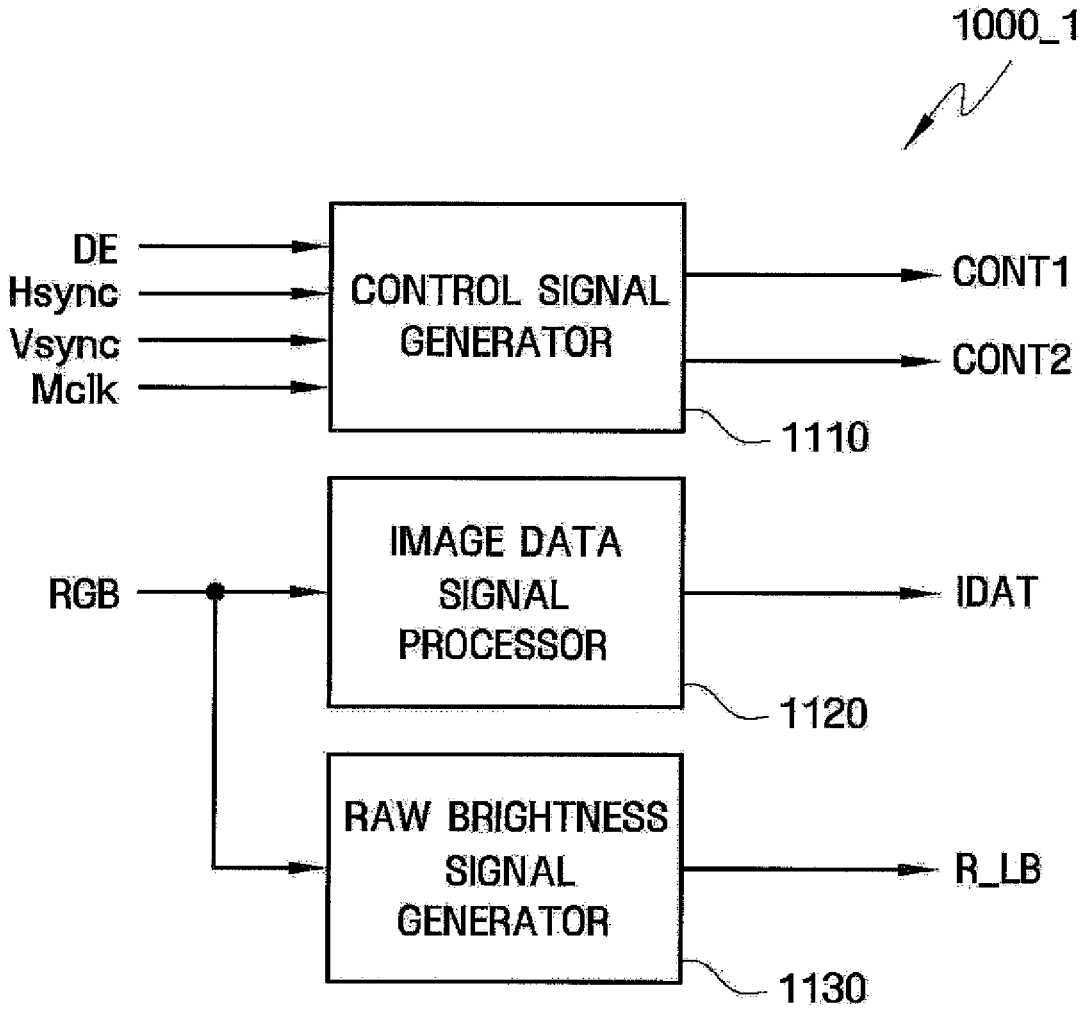
FIG. 3 is a block diagram of exemplary circuits implementing the image data signal controller in the display of FIG. 1.
Figure 4:
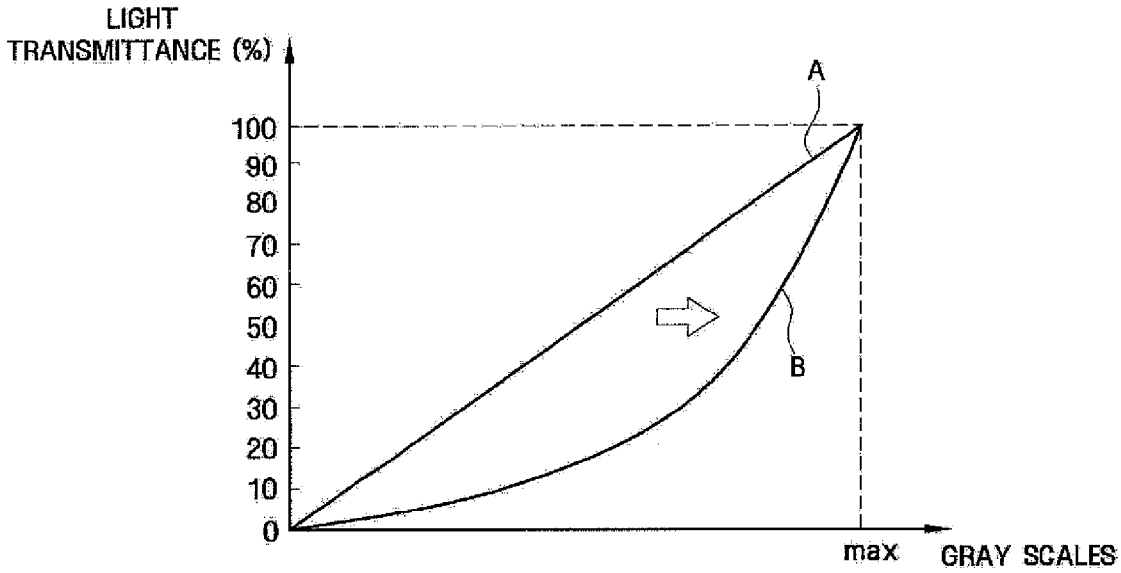
FIG. 4 is a graph illustrating an exemplary gamma conversion of an image data signal processor in the image data signal controller of FIG. 3.

FIG. 3 is a block diagram of exemplary circuits implementing the image data signal controller 1000_1 in the display of FIG. 1, and FIG. 4 is a graph illustrating an exemplary gamma conversion of an image data signal processor 1120 in the image data signal controller 1000_1 of FIG. 3.

Referring to FIG. 3, the image data signal controller 1000_1 includes a control signal generator 1110, an image data signal processor 1120, and a raw brightness signal generator 1130.

The control signal generator 1110 receives control signals and outputs a data control signal CONT1 and a gate control signal CONT2. Here, the control signals include a vertical synchronizing signal Vsync, a horizontal synchronizing signal Hsync, a main clock MCLK, and a data enable signal DE.

The data control signal CONT1 is supplied to the data driver 500 to control the operation of the data driver 500, and includes a horizontal synchronizing start signal to begin the operation of the data driver 500, a load signal instructing to apply data voltages to the data lines D1-Dm, a "reverse" signal to reverse the polarity of the data voltages with respect to a common voltage Vcom, and as is well known in the art.

The gate control signal CONT2 is supplied to the gate driver 400 to control the operation of the gate driver 400, and includes a scanning start signal to indicate the start of scanning, at least one gate clock signal to control the output timing of a gate-on voltage Von, and an output enable signal to control the output duration of the gate-on signal Von as is well known in the art.

The image data signal processor 1120 converts the raw image data signals RGB into the converted image data signals IDAT, and outputs the same. The converted image data signals IDAT may be gamma-converted reproductions of the raw image data signals RGB to be displayed on the display panel to improve image quality. In other words, the raw image data signal signals RGB may have a first set of gray scale voltages (first gamma), and the converted image data signals IDAT may have a second sect of gray scale voltages (second gamma).

As illustrated in FIG. 4, the image data signal processor 1120 may gamma-convert the raw image data signals RGB having the first set of gray scale voltages corresponding to a first gamma curve (A), into the converted image data signals IDAT having the second set of gray scale voltages corresponding to a second gamma curve (B), and outputs the second set. Here, the image data signal processor 1120 may use a lookup table (not shown) in which the second set of gray scale voltages corresponding to first set of gray scale voltages are stored to convert the raw image data signals RGB into the converted image data signals IDAT.

The raw brightness signal generator 1130 receives the raw image data signals RGB and generates a raw brightness signal R_LB. The raw brightness signal generator 1130 receives the raw image data signals RGB, averages the same to determine a representative image data signal, and generates the raw brightness signal R_LB corresponding to raw brightness of back light to be supplied from the light-emitting block 850 based on the representative image data signal.

Figure 5:
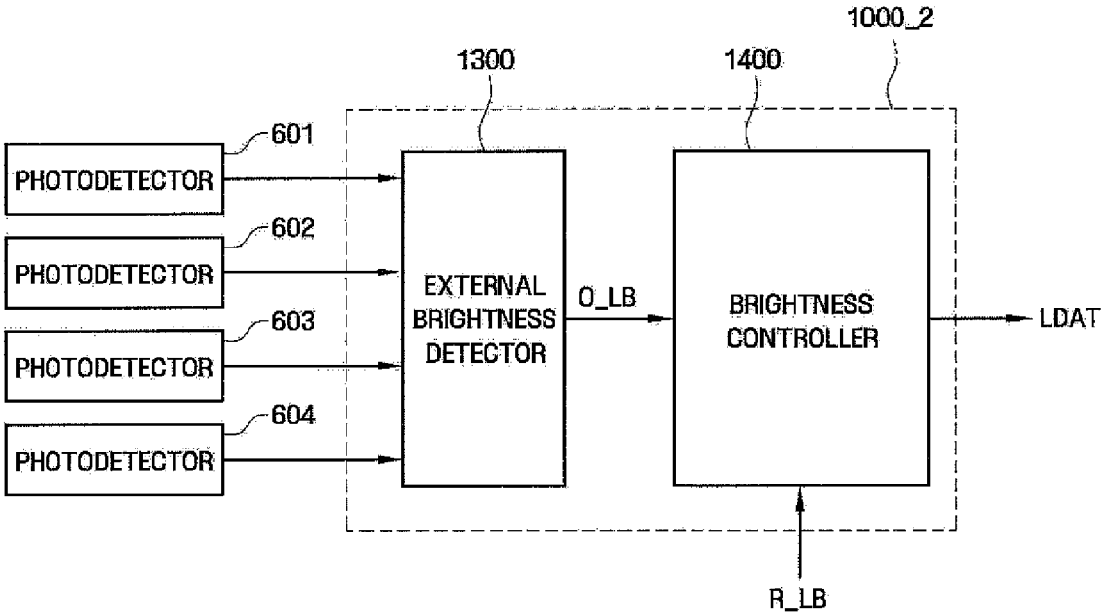
FIG. 5 is a block diagram of exemplary circuits implementing the light data signal controller in the display of FIG. 1.

FIG. 5 is an block diagram of exemplary circuits implementing the light data signal controller 1000_2 in the display of FIG. 1.

Referring to FIG. 5, the light data signal controller 1000_2 receives a raw brightness signal R_LB (raw brightness signal generator 1130), receives the detected-light signals from the photodetectors 601-604 and outputs a light data signal LDAT. The light data signal controller 1000_2 includes an external-brightness detector 1300 and a brightness controller 1400.

The external-brightness detector 1300 receives the detected-light signals from the photodetectors 601-604 and outputs an external-brightness signal O_LB based thereon. In the first mode, the external-brightness detector 1300 senses a voltage level of the light-detecting node connected to the photodetectors 601-604 and supplies the outputs the external-brightness signal O_LB based on the sensed voltage levels. In the second mode, the external-brightness detector 1300 senses a current level of the light detecting node connected to the photodetectors 601-604 and outputs the external-brightness signal O_LB based on the sensed current level. This will later be described in more detail with reference to the block diagram of the external-brightness detector 1300 in FIG. 6.

The brightness controller 1400 controls the brightness of the backlight behind an image displayed on the display panel 300 based upon to the external-brightness signal O_LB and based upon the raw brightness signal R_LB. The brightness controller 1400 outputs light data signal LDAT to the backlight driver 800 and varies the brightness of the backlight according to the detected brightness of displayed external light based on the external-brightness signal O_LB supplied from the external-brightness detector 1300 and according to the raw brightness signal R_LB supplied from the image data signal controller 1000_1. The operation of the brightness controller 1400 will later be described in greater detail with reference to FIG. 7.

Referring again to FIG. 1, the gate driver 400 receives the gate control signal CONT2 and a gate-off voltage Voff, and sequentially supplies the gate-on voltage Von to the plurality of gate lines G1-Gn. The gate driver 400 is enabled in response to the scanning start signal for each frame and sequentially supplies the gate-on voltage Von to the plurality of gate lines G1-Gn in synchronization with the gate clock signal.

The data driver 500 supplies data voltages corresponding to the converted image data signals IDAT to the plurality of data lines D1-Dm using a plurality of gray scale voltages supplied from a gray scale voltage generator (not shown), the converted image data signals IDAT supplied from the signal controller 1000, and the data control signal CONT1.

The backlight driver 800 adjusts the brightness of backlight supplied from the light-emitting block 850 in response to the light data signal LDAT. The brightness of backlight supplied from the light-emitting block 850 may vary according to a pulse width or duty ratio of the light data signal LDAT, which will be described in more detail later with reference to FIG. 8.

The light-emitting block 850, includes at least one light source, may supplies the display panel 300 with backlight. The light-emitting block 850 may be positioned at a bottom of the display panel 300 and supply backlight from the bottom of the display panel 300. As shown in FIG. 1, the light-emitting block 850 may comprise, for example, a plurality of point light sources such as light emitting diode (LED), but is not limited thereto. The light-emitting block LB may comprise a point light source or alternately a linear light source.

Figure 6:
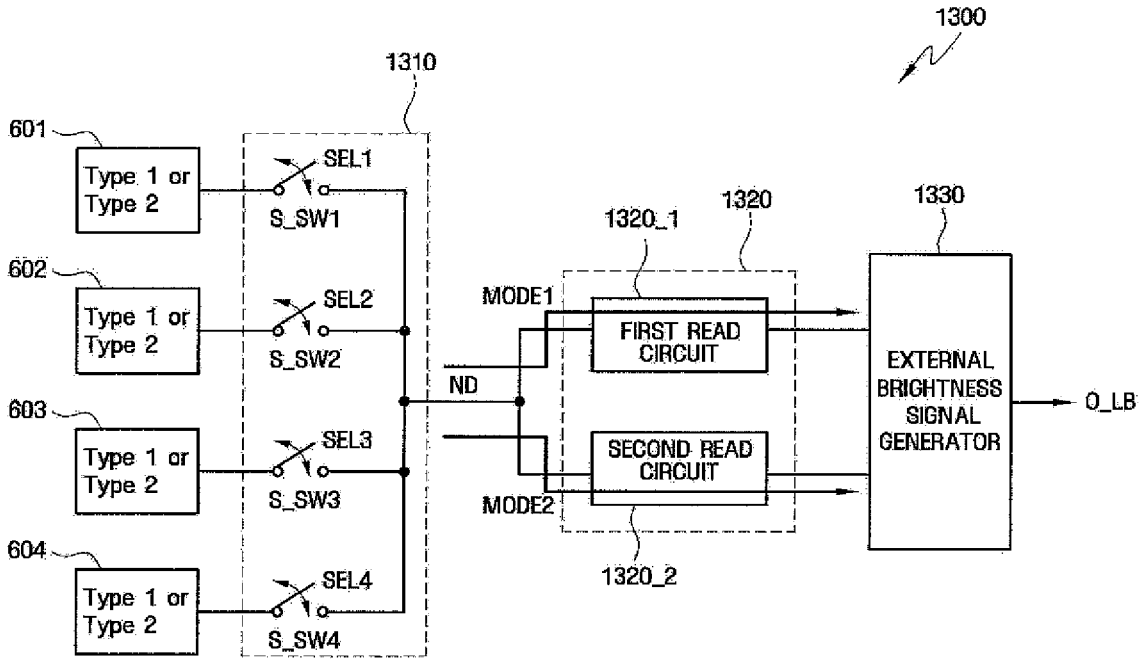
FIG. 6 is n block diagram of the external-brightness detector in the light data signal controller in FIGS. 1 and 5.

FIG. 6 is a block diagram of the explaining an external-brightness detector 1300 in the light data signal controller 1000_2 in FIGS. 1 and 5.

Referring to FIG. 6, the external-brightness detector 1300 includes a selection block 1310, a read circuit 1320, and an external-brightness signal generator 1330.

The selection block 1310 includes a plurality of switches S_SW1-S_SW4 and selectively connects a selected on of the plurality of photodetectors 601-604 to the light detecting node ND in response to selection signals SEL1-SEL4, and. The selection block 1310 may sequentially connect the first to fourth photodetectors 601-604 to the light detecting node ND as the first to fourth switches S_SW1-S_SW4 are sequentially enabled by the selection signals SEL1-SEL4.

The light detecting node ND, connected to the photodetectors 601-604 and the read circuit 1320, will have voltage and/or current levels that varying according to the light detected by the photodetectors 601-604. The voltage level or the current level of the light detecting node ND may vary according to the type of each of the photodetectors 601-604 connected (see FIGS. 10 and 12).

The read circuit 1320 is connected to the photodetectors 601-604 through the light detecting node ND, and reads the light detected from the photodetectors 601-604 by sensing the voltage and/or current level at the light detecting node ND. The read circuit 1320 performs analog to digital conversion and reads analog voltage and/or current level signals from the photodetectors 601-604 and outputs digital signals as read results to the external-brightness signal generator 1330.

The read circuit 1320 includes a first read circuit 1320_1 and a second read circuit 1320_2. The first read circuit 1320_1 may be selectively enabled in the first mode to sense the voltage level of the light detecting node. The second read circuit 1320_2 may be selectively enabled in the second mode to sense the current level of the light detecting node.

When the read circuit 1320 is connected to the photodetectors 601-604 all being of Type 1 in which the voltage level of the light detecting node ND varies according to the light detected, the first read circuit 1320_1 is selectively enabled to sense the voltage level of the light detecting node ND and outputs the digital signal representing the sensed voltage level as a read result. On the other hand, when the read circuit 1320 is connected to the photodetectors 601-604 all being of Type 2 in which the current level of the light detecting node ND varies according to the light detected, the second read circuit 1320_2 is selectively enabled to sense the current level of the light detecting node ND and outputs the digital signal representing the sensed current level as a read result.

The read circuit 1320 senses the voltage level or the current level of the light detecting node ND and outputs a digital signal representing the same as the read result based on being connected to the photodetectors 601-604 of Type 1 or Type 2 in which a voltage or current level of the light detecting node ND varies according to the light detected. The light of the light detecting node ND can be sensed and digitized based on the type(s) of the photodetectors 601-604 mounted on the display panel 300. The external-brightness signal O_LB can be supplied based on the sensed light using a single external-brightness detector 1300 without having to change the configuration of the external-brightness detector (specifically, the read circuit 1320) based on photodetector component selections. If the respective drivers of the display, such as the signal controller 1000, the gate driver 400, or the data driver 500, are implemented by a single integrated circuit chip, the display can be driven with either type of the photodetectors 601-604 mounted on the display panel 300 without changing the configuration of the chip.

The exemplary configuration and operation of the read circuit 1320 will later be described in detail with reference to FIGS. 9 through 12.

The external-brightness signal generator 1330 generates the external-brightness signal O_LB corresponding to the detected brightness of external light based on the digital read result output from the read circuit 1320. The external-brightness signal generator 1330 generates the external-brightness signal O_LB based on the read result supplied from the first read circuit 1320_1 while operating in the first mode. The external-brightness signal generator 1330 generates the external-brightness signal O_LB based on the read result supplied from the second read circuit 1320_2 while operating in the second mode.

For example, if the plurality of photodetectors 601-604 include an external photodetector detecting external light and a reference photodetector detecting reference light (Hereinafter, the "reference light" is complete darkness, obtained by surrounding the reference photodetector with a shielding block preventing external light from entering it), the external-brightness signal generator 1330 compares a read result of the external light detected from each external photodetector with a read result of the reference light detected from the reference photodetector and outputs the external-brightness signal O_LB. Thus, correlated double sampling may be performed to account for the voltage across the photodetectors in a zero-light state. In addition, if the plurality of photodetectors 601-604 include a first photo diode detecting external light and a second photo diode serially connected to the first photo diode and detecting the reference light, the external-brightness signal generator 1330 and/or the read circuit 1320 averages read results of the light detected from the respective photodetectors 601-604 and outputs the external-brightness signal O_LB.

Figure 7:
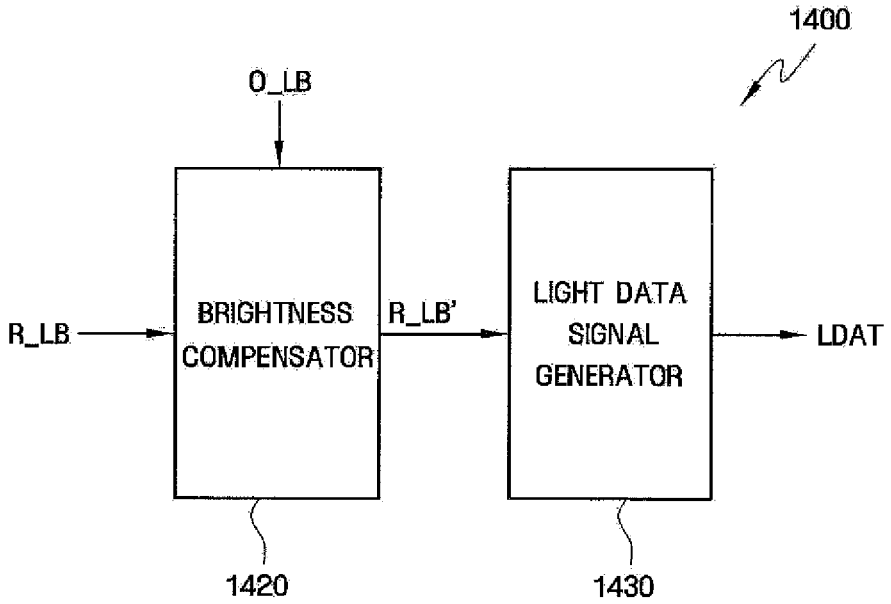
FIG. 7 is a block diagram of the brightness controller in the light data signal controller in FIGS. 1 and 5.

FIG. 7 is a block diagram of the brightness controller 1400 in the light data signal controller 1000_2 in FIGS. 1 and 5.

Referring to FIG. 7, the brightness controller 1400 includes a brightness compensator 1420 and a light data signal generator 1430.

The brightness compensator 1420 outputs a brightness signal R_LB' based on the received raw brightness signal R_LB and the external-brightness signal O_LB. The brightness compensator 1420 compensates the raw brightness signal R_LB based on the external-brightness signal OLB corresponding to the brightness of external light and outputs the compensated brightness signal R_LB'.

The light data signal generator 1430 generates the light data signal LDAT corresponding to the compensated brightness signal R_LB'. The light data signal generator 1430 receives the compensated brightness signal R_LB' (compensating for the brightness of ambient light), and provides the light data signal LDAT to the backlight driver 800. The pulse width of the light data signal LDAT supplied from the light data signal generator 1430 may be adjusted according to the brightness signal R_LB'.

Figure 8:
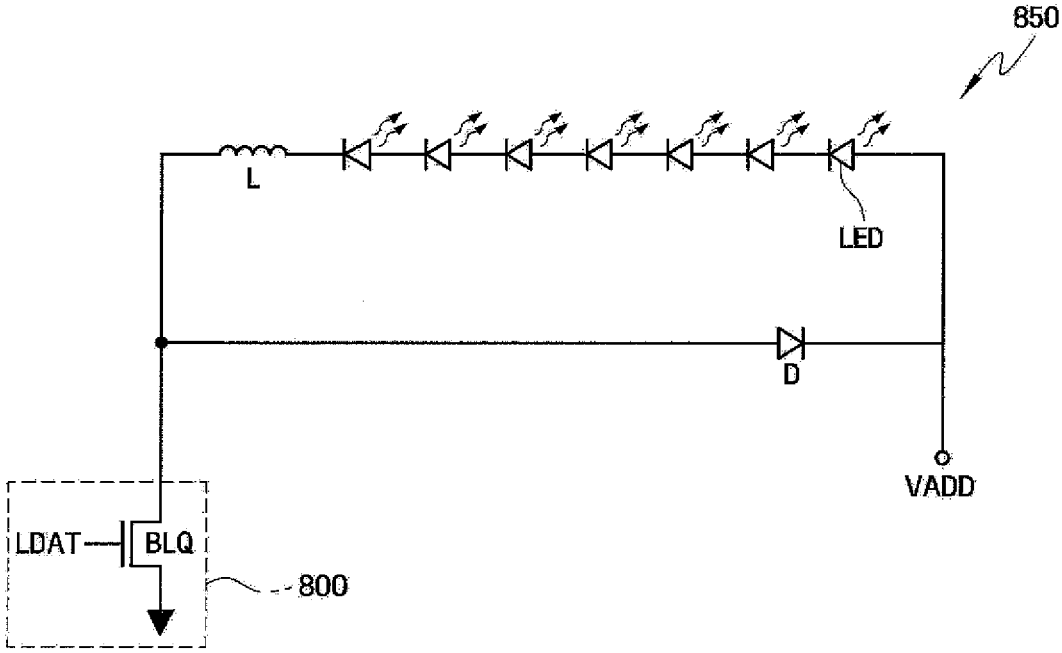
FIG. 8 is a circuit diagram of an exemplary LED backlight unit in the display of FIG. 1.

FIG. 8 is a circuit diagram illustrating of an exemplary LED backlight unit 800 & 850 in the display of FIG. 1.

Referring to FIG. 8, the backlight driver 800 includes a switching element BLQ enabled in response to the light data signal LDAT, and controls the brightness of the light-emitting block 850 according to the pulse width of light data signal LDAT. Here, the switching element BLQ may be a transistor interposed between a ground voltage and a power supply voltage VADD, having the light data signal LDAT applied to its control gate.

When the light data signal LDAT is at a high level, the switching device BLQ of the backlight driver 800 is turned ON and the power supply voltage VADDD is supplied to the light-emitting block 850, so that current flows through the light-emitting block 850 and an inductor L. Here, some of the energy in the current is stored in the inductor L. When the light data signal LDAT is at a low level, the switching device BLQ is turned OFF, forming a closed circuit composed of the light-emitting block 850, the inductor L, and a diode D, so that current flows through the closed circuit. Here, as the energy stored in the inductor L is discharged, the amount of current stored in the inductor L is reduced. Since the time during which the switching device BLQ is turned ON is adjusted according to the duty ratio of the light data signal LDAT, the brightness of the light-emitting block 850 is controlled by the duty ratio of the light data signal LDAT.

Since the pulse width of the light data signal LDAT is adjusted according to the brightness of external (ambient) light as described above, the brightness of the light-emitting block 850 can also be controlled according to the brightness of external light. If the brightness of external light is at a high level, the pulse width of the light data signal LDAT is increased, so that the brightness of the backlight is increased. On the other hand, if the brightness of external light is at a low level, the pulse width of the light data signal LDAT is decreased, so that the brightness of the backlight is decreased.

Hereinafter, an external-brightness detector according to an exemplary embodiment of the present invention will be described with reference to FIGS. 9 through 12.

Figure 9:
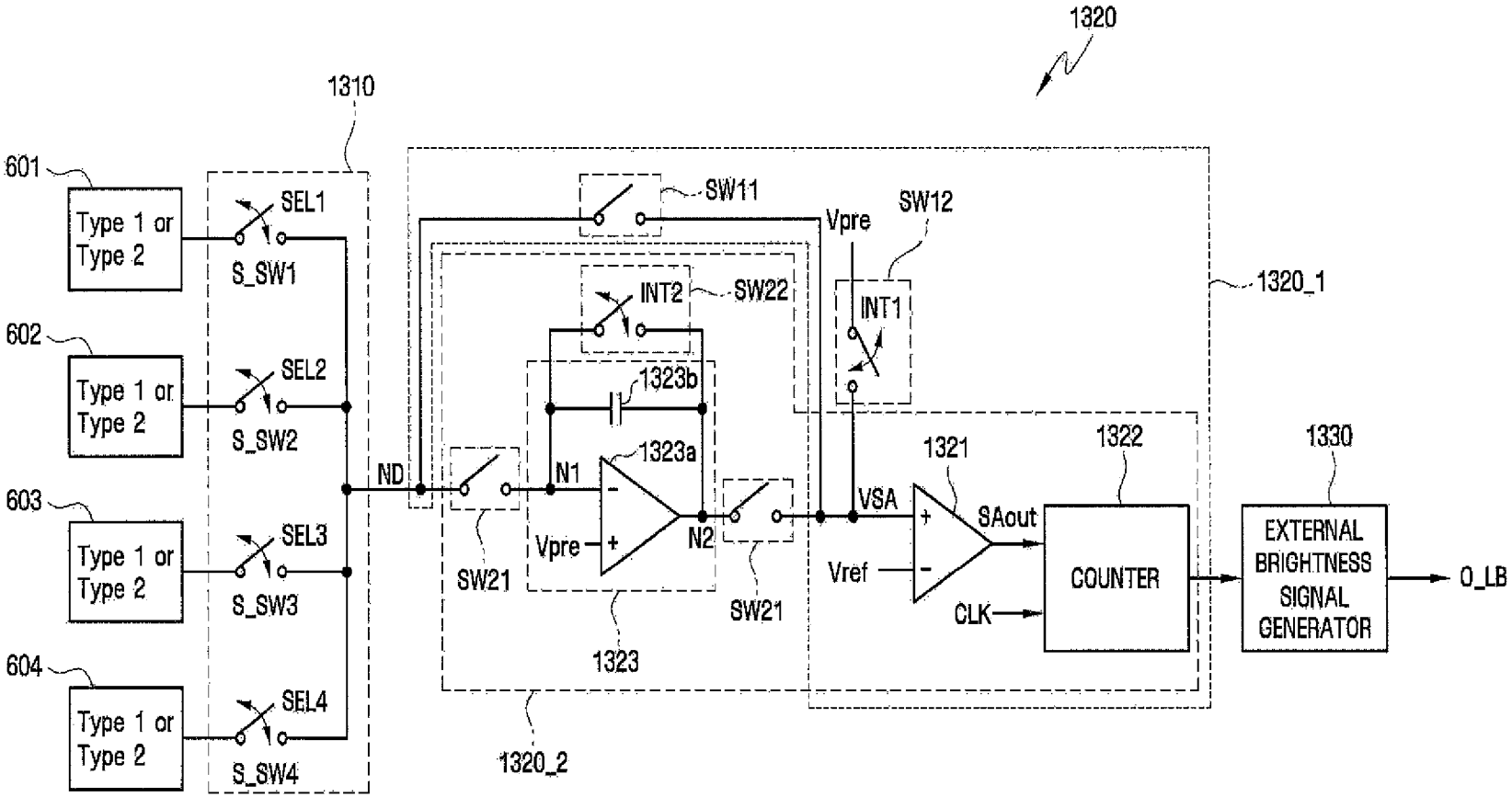
FIG. 9 is a block diagram of an exemplary implementation of the external-brightness detector in the display of FIG. 1.

FIG. 9 is a block diagram of an external-brightness detector according to an exemplary embodiment of the present invention.

Referring to FIG. 9, the external-brightness detector 1300 includes a selection block 1310, a read circuit 1320, and an external-brightness signal generator 1330. The selection block 1310 and the external-brightness signal generator 1330 have already been described above with reference to FIG. 6, and a detailed description thereof will not be repeated.

The read circuit 1320 is connected to the plurality of photodetectors 601-604 through the light detecting node ND, and reads the light detected from the photodetectors 601-604 by sensing the state of the light detecting node ND. As shown in FIG. 9, the read circuit 1320 includes a first read circuit 1320_1 and a second read circuit 1320_2. The read result output from the read circuit 1320 to the external-brightness signal generator 1330 is a digital signal.

The first read circuit 1320_1 is selectively enabled in the first mode wherein the voltage level of the light detecting node ND is sensed. When the read circuit 1320 is connected to the photodetectors 601-604 of Type 1 in which a voltage level of the light detecting node ND varies according to the light detected, the first read circuit 1320_1 is selectively enabled to sense the voltage level of the light detecting node ND and outputs the sensed voltage level as a digital read result.

The first read circuit 1320_1 includes a first switch SW11 selectively connecting the light detecting node ND to a sensing node VSA, and a voltage sensor 1321 for comparing a voltage level of the sensing node VSA with a reference bias level Vref and outputting a comparison result SAout. In addition, the first read circuit 1320_1 may include a first initializer switch SW12 connected to the sensing node VSA for initializing the first read circuit 1320_1, and a counter 1322 for outputting the digital read result based on the comparison result SAout output from the voltage sensor 1321 and a clock signal CLK.

The second read circuit 1320_2 is selectively enabled in the second mode wherein the current level of the light detecting node ND is sensed. When the read circuit 1320 is connected to the photodetectors 601-604 of Type 2 in which a current level of the light detecting node ND varies according to the light detected, the second read circuit 1320_2 is selectively enabled to sense the current level of the light detecting node ND and outputs the sensed current level as a read result.

The second read circuit 1320_2 includes a current-voltage converter 1323 selectively connected between the light detecting node ND and the sensing node VSA by the second switch SW_21, and the voltage sensor 1321 for comparing the voltage level of the sensing node VSA with the reference bias level Vref and outputting a comparison result SAout. In addition, the second read circuit 1320_2 may include the first initializer SW12 connected to the sensing node VSA for initializing the first read circuit 1320_1, and the counter 1322 for outputting the digital read result based on the comparison result SAout output from the voltage sensor 1321 and a clock signal CLK.

The current-voltage converter 1323 may be implemented as an analog integrator, as shown in FIG. 9. The current-voltage converter 1323 may be an analog integrator including a comparator 1323*a* having a first input terminal N1 connected to the light detecting node ND through the second switch SW_21 and a second input terminal to which a precharge voltage Vpre is applied, and a capacitor 1323*b* connected between the first input terminal N1 and the output terminal N2 of the comparator 1323*a*. However, the current-voltage converter 1323 may be implemented in various manners in alternative embodiments.

The second read circuit 1320_2 may further include a second initializer switch SW22 connected to both terminals N1 and N2 of the current-voltage converter 1323 for initializing the second read circuit 1320_2, and a counter 1322 for outputting a digital read result based on the comparison result SAout output from the voltage sensor 1321 and the clock signal CLK.

Thus, the first and second read circuits 1320_1 and 1320_2 according to an exemplary embodiment share the voltage sensor 1321 for comparing the voltage level of the sensing node VSA with the reference bias level Vref and for outputting the comparison result SAout, and the counter 1322 for outputting the digital read result based on the comparison result SAout output from the voltage sensor 1321 and the clock signal CLK.

In the first and second modes, the first and second read circuits 1320_1 and 1320_2 are selectively enabled according to the states of the first and second switches SW_11 and SW_21 and the first and second initializer switches SW12 and SW22. In the first and second modes, the states of the first and second switches SW_11 and SW_21, and the first and second initializer switches SW12 and SW22 are as shown below in Table 1.

TABLE 1

| | SW_11 | SW_21 | SW12 | SW22 |
|---|---|---|---|---|
| MODE1 | enable | Disable | selective | don't care |
| MODE2 | disable | enable | disable | selective |

In Table 1, "enable" and "disable" indicate the "ON" and "OFF" states of switches SW11-SW22, respectively, "selective" indicates that the switch, SW12 or SW22, is selectively enabled according to first and second initialization signals INT1 and INT2 in the first or second mode, and "don't care" indicates that the component, e.g., SW22, may be either in an enabled state or a disabled state in the first or second mode. Thus, since the operation of the read circuit 1320 shown in FIG. 9 in the first mode is substantially the same irrespective of the state of the second initializer switch SW22, the second initializer switch SW22 may be in an enabled state or a disabled state.

Hereinafter, the operation of the external-brightness detector 1300 shown in FIG. 9 in the first mode will be described with reference to FIGS. 10 and 11, and, the operation of the external-brightness detector 1300 shown in FIG. 9 in the second mode will be described with reference to FIGS. 12 and 13.

Figure 10:
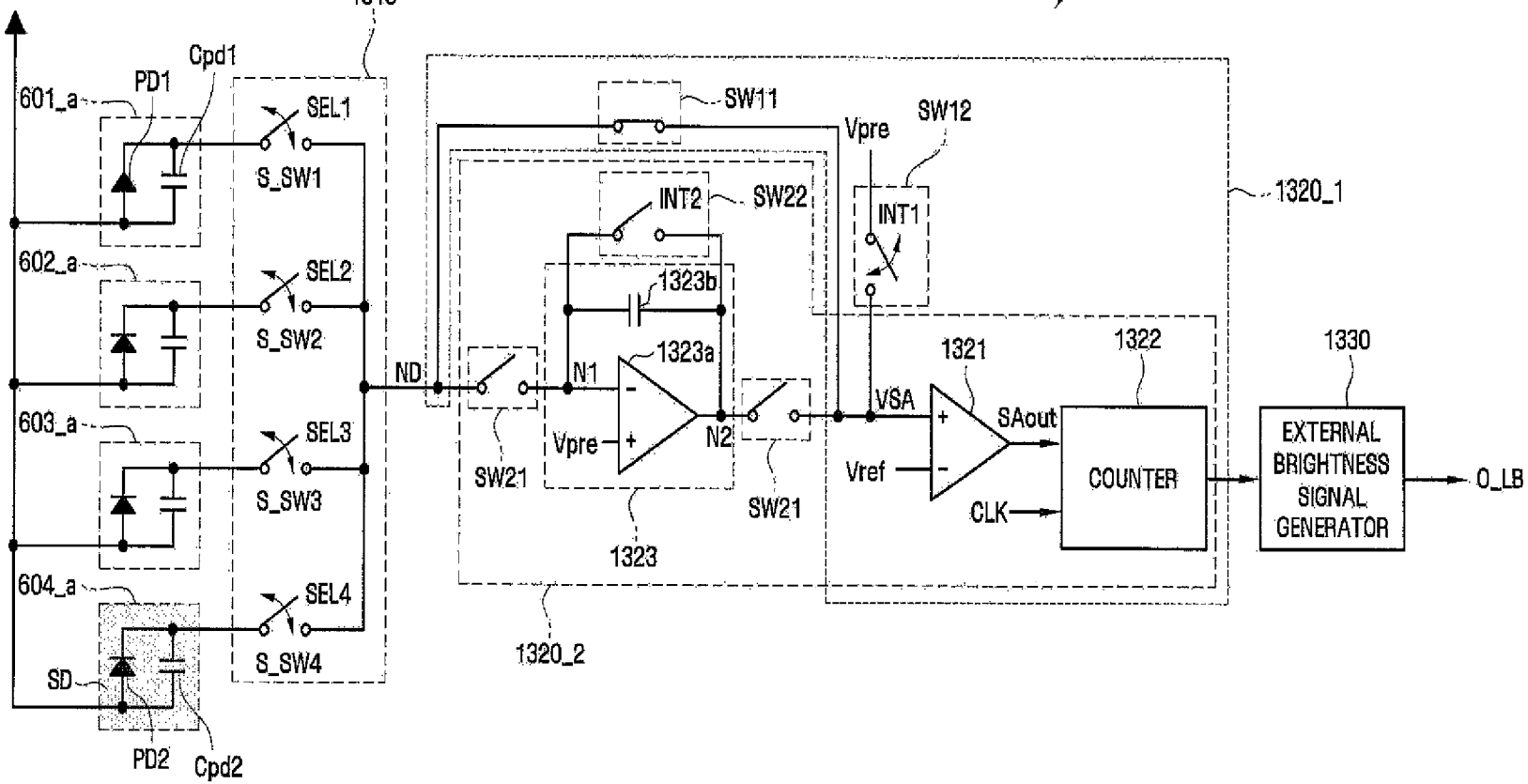
FIGS. 10 is a circuit diagram and FIG. 11 is a corresponding timing diagram illustrating the operation of the external-brightness detector of FIG. 9 in a first mode.

FIG. 10 is a circuit diagram and

Figure 11:
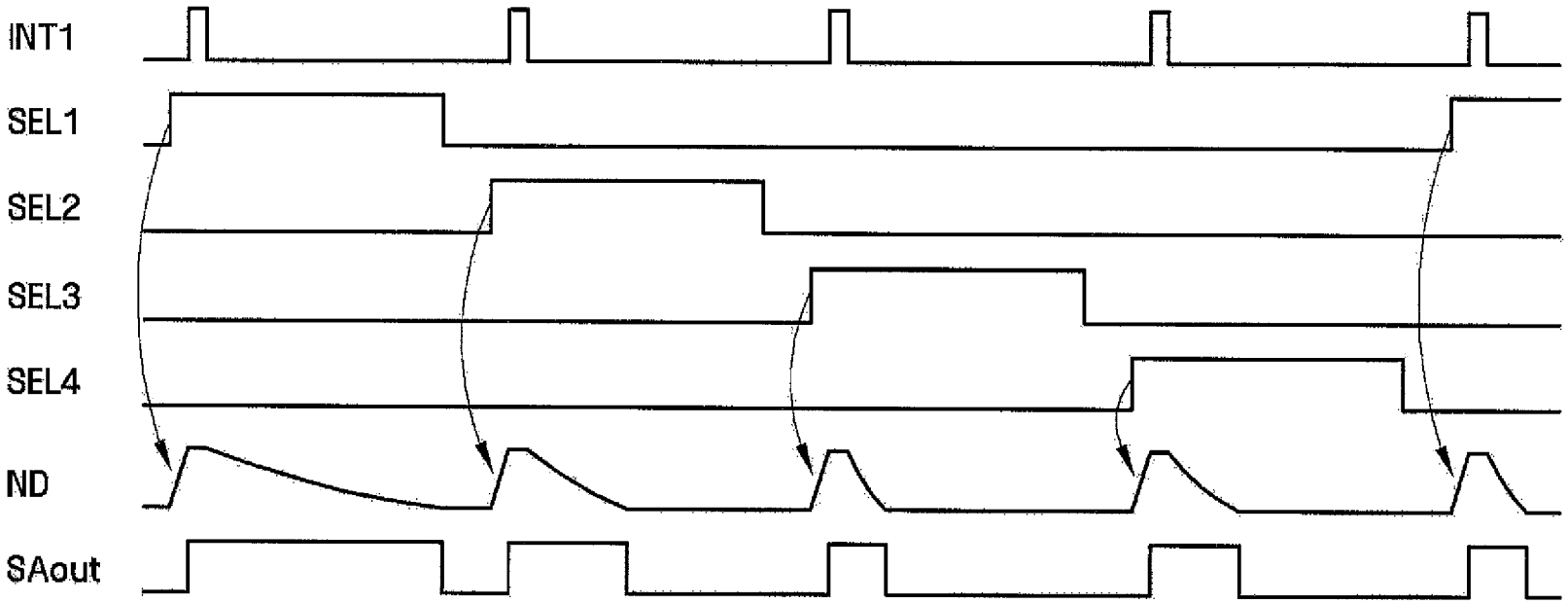

FIG. 11 is a corresponding timing diagram illustrating the operation of the external-brightness detector shown in FIG. 9 while operating in the first mode.

Referring to FIGS. 10 and 11, the external-brightness detector 1300 operates such that in the first mode, the first switch SW11 is enabled, the second switch SW_21 is disabled and the first initializer switch SW12 is selectively enabled in response to the first initialization signal. Thus, the first read circuit 1320_1 is selectively enabled in the first mode.

The first switch SW11 is enabled and the second switch SW_21 is disabled, so that the light detecting node ND and the sensing node VSA of the voltage sensor 1321 are conductively connected to each other, and the first initializer switch SW12 is selectively enabled in response to the first initialization signal INT1 to apply the precharge voltage Vpre to the sensing node VSA. The first initializer switch SW12 is enabled to initialize the first read circuit 1320_1 before each of the respective photodetectors 601_*a*-604_*a* are sequentially connected to the light detecting node ND by selection signals SEL1-SEL4, as shown in FIG. 11.

The photodetectors 601_*a*-604_*a* are selectively connected to the light detecting node ND by the selection signals SEL1-SEL4 to make a voltage level of the light detecting node ND vary according to the light detected by one of the photodetectors 601_*a*-604_*a*. As shown in FIG. 10, the photodetectors 601_*a*-604_*a* may include external photodetectors 601_*a*-603_*a* detecting external light and a reference light photodetector 604_*a* detecting reference light (total darkness).

The external photodetectors 601_*a*-603_*a* may include a first photo diode PD1 detecting external light, and a first capacitor Cpd1 parallel-connected to the first photo diode PD1. The reference photodetector 604_*a* includes a second photo diode PD2 detecting reference light that is shielded from all light (e.g., from all external light) by an external light shielding block SD, and a second capacitor Cpd2 parallel-connected to the second photo diode PD2.

Since each of the first and second photodetectors 601_*a*-604_*a* respectively have the first and second photo diodes PD1 and PD2 through which current flows from the light detecting node ND to a ground voltage according to the intensity of light (external light or reference light), the voltage level of the light detecting node ND may vary. Thus, as the current flows from the light detecting node ND to the ground voltage according to the intensity of light (external light or reference light) through the first and second photo diodes PD1 and PD2, the voltage level of the sensing node VSA connected to the light detecting node ND through the first switch SW11 may be fall from the precharge voltage level Vpre to a predetermined low level in a time period that varies according to the intensity of the detected light.

The voltage sensor 1321 compares the voltage level of the sensing node VSA with the reference bias level Vref and outputs a comparison result SAout. For example, if the voltage level of the sensing node VSA is higher than the reference bias level Vref, a high-level voltage is output as the comparison result SAout. If the voltage level of the sensing node VSA is lower than the reference bias level Vref, a low-level voltage is output as the comparison result SAout.

The counter 1322 outputs a digital read result using the comparison result SAout output from the voltage sensor 1321 and the clock signal CLK. The counter 1322 counts (measures) the time period in which the comparison result SAout in a high level is output from the voltage sensor 1321, and outputs the counted time as the digital read result (corresponding to the intensity of light detected from the selected one of the photodetectors 601-604) to the external-brightness signal generator 1330.

The external-brightness signal generator 1330 generates an external-brightness signal O_LB based on a digital read results out of the first read circuit 1320_1. The external-brightness signal generator 1330 may generate an external-brightness signal O_LB based on a first read result of external light detected from the external photodetectors 601_*a*-603_*a* and a second read result of reference light (zero light) detected from the reference photodetector 604_a. For example, the external-brightness signal generator 1330 may calculate the difference between the read results of the external light and the reference light, and generate the external-brightness signal O_LB corresponding to the brightness of external light based on the obtained difference.

Figure 12:
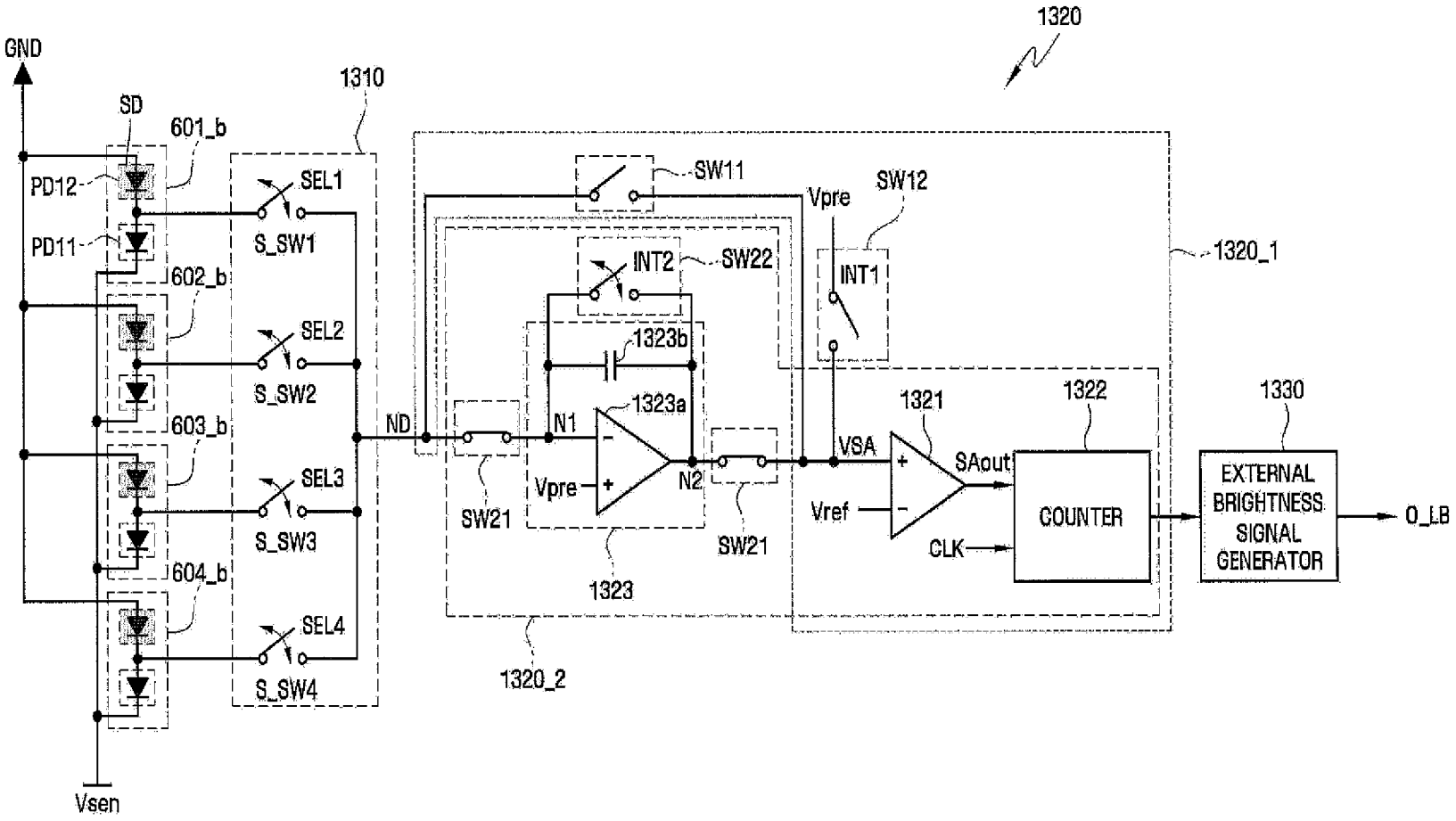
FIGS. 12 is a circuit diagram and FIG. 13 is a corresponding timing diagram illustrating the operation of the external-brightness detector of FIG. 9 in a second mode.
Figure 13:
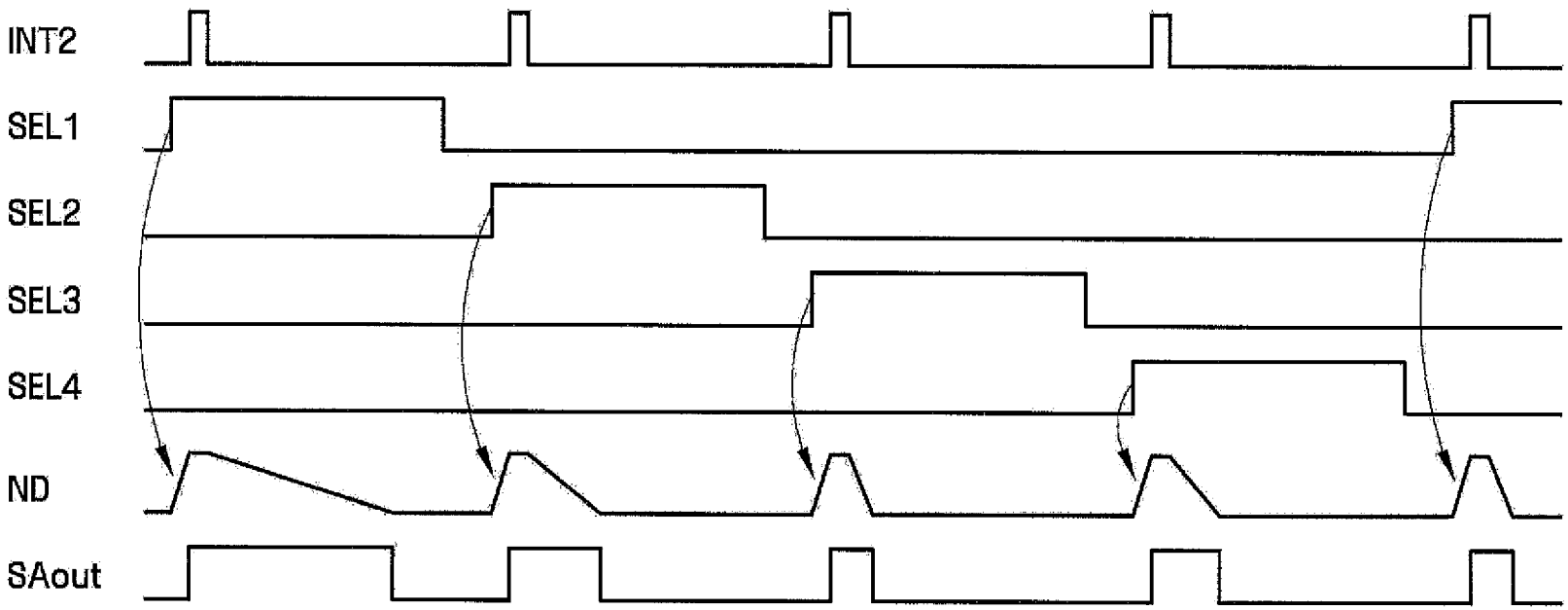

FIG. 12 is a circuit diagram and FIG. 13 is a corresponding timing diagram illustrating the operation of the external-brightness detector of FIG. 9 in a second mode.

Referring to FIGS. 12 and 13, in the second mode, the second read circuit 1320_2 of the external-brightness detector 1300 is enabled to read currents indicating light intensity. Thus, the first switch SW11 and the first initializer switch SW12 are disabled, the second switch SW_21 is enabled, and the second initializer switch SW22 is selectively enabled according to the second initialization signal INT2.

The first switch SW11 is disabled, the second switch SW_21 is enabled so that the current-voltage converter 1323 is connected between the light detecting node ND and the sensing node VSA of the voltage sensor 1321 and the second initializer switch SW22 is selectively enabled in response to the second initialization signal INT2. Thus, voltage levels of first and second input terminal N1 and N2 of the comparator 1323*a* become equalized at each initialization. As described above, the second initializer switch SW22 is enabled to initialize the second read circuit 1320_2 before each one off the respective photodetectors 601_*b*-604_*b* is sequentially connected to the light detecting node ND by the selection signals SEL1-SEL4.

The photodetectors 601_*b*-604_b are selectively connected to the light detecting node ND by the selection signals SEL1-SEL4 to make the current and/or voltage level of the light detecting node ND vary according to the light detected. As shown in FIG. 12, each of the photodetectors 601_*b*-604_b includes a first photo diode (e.g., PD11) and a second photo diode (e.g., PD12) serially connected between a first voltage Vsen and a second voltage GND. Here, the first photo diode PD11 detects external light and the second photo diode PD12 detects reference light (zero light) being shielded from the external light by a shielding block SDt. Since current flows from the first voltage Vsen to the second voltage GND, the current level at the light detecting node ND may vary according to the intensity of light (external light or reference light) through the first and second photo diodes PD1 and PD2. The current through second switch SW_21 will be the difference between the currents through the first and second photo diodes PD1 and PD2.

The current-voltage converter 1323 connected between the light detecting node ND and the sensing node VSA through the second switch SW_21 varies the voltage level of the sensing node VSA vary in response to the current level of the light detecting node ND. Since the amounts of charges, (specifically positive charges) charged in the first input terminal N1 of the current-voltage converter 1323 vary according to the variation in the current level of the light detecting node ND, the voltage level of the sensing node VSA connected to the output terminal N2 of the current-voltage converter 1323 may vary according to the variation in the current level of the light detecting node ND.

Referring to FIGS. 11 and 13, when the photodetectors 601_*b*-604_*b* shown in FIG. 12 are connected to the read circuit 1320, the times in which the voltage level of the sensing node VSA reaches a reference bias level Vref in response to the same intensity of light may be shorter than that when the photodetectors 601_*a*-604_*a* shown in FIG. 10 are connected to the read circuit 1320. This is because the constant voltage levels Vsen and GND are applied to the first and second photo diodes PD11 and PD12 shown in FIG. 12 but the voltage level of the light detecting node ND shown in FIG. 10 gradually decreases with the lapse of time.

As described above, the voltage sensor 1321 compares a voltage level of the sensing node VSA with the reference bias level Vref and outputs a comparison result SAout. The counter 1322 outputs a digital read result using the comparison result SAout output from the voltage sensor 1321 and a clock signal CLK.

The external-brightness signal generator 1330 generates an external-brightness signal O_LB based on the digital read result out of the second read circuit 1320_2. The external-brightness signal generator 1330 calculates an average value of the (four) read results of the light detected from the respective photodetectors 601-604, and generates external-brightness signals O_LB corresponding to the average brightness of external light based on the obtained average value.

Meanwhile, in a read circuit (not shown) according to an alternative embodiment of the present invention may comprise a current sensing unit and a voltage-current converter, instead of a voltage sensor and a current-voltage converter. In the read circuit according to an alternative embodiment of the present invention, the current sensing unit may compare a current level of a sensing node connected to a light detecting node with a reference bias level, and outputs a comparison result. The voltage-current converter is selectively connected between the light detecting node and the sensing node and varies a current voltage of the sensing node in response to the voltage level of the light detecting node.

Therefore, the read circuit according to the alternative embodiment of the present invention can provide the read result of the voltage level or the current level of the light detecting node varying according to the light detected from the photodetector, irrespective of the configuration of the read circuit.

While the present invention has been particularly shown and described with reference to exemplary embodiments thereof, it will be understood by those of ordinary skill in the art that various changes in form and details may be made therein without departing from the spirit and scope of the present invention as defined by the following claims. Exemplary embodiments of the present invention are described herein with reference to a liquid crystal display (LCD), but the invention can also be applied to a flat panel display such as an organic light emitting diode display (OLED), a plasma display panel (PDP), a surface-conduction electron-emitter display (SED display), or the like. Accordingly, embodiments of the present invention should not be construed as limited to the particular illustrative examples provided herein. It is therefore intended that the present embodiments be considered in all respects as illustrative and not restrictive, reference being made to the appended claims rather than the foregoing description to indicate the scope of the invention.

What is claimed is:

1. A display comprising:

a display panel that displays an image;

an external-brightness detector including a light detecting node configured to be connected to a first photodetector configured to detect ambient light while the external-brightness detector operates in a first mode and configured to be connected to a second photodetector configured to detect ambient light while the external-brightness detector operates in a second mode; and wherein the external-brightness detector outputs a digital external-brightness signal based on sensing the light detecting node and wherein the digital external-brightness signal is based on measuring the analog voltage level of the light detecting node while the external-brightness detector operates in the first mode while connected to the first photodetector and by measuring the analog electric-current level of the light detecting node while the external-brightness detector operates in the second mode while connected to the second photodetector; and a brightness controller that controls the brightness of the image displayed on the display panel according to the digital external-brightness signal.

2. The display of claim 1, wherein the external-brightness detector includes a read circuit that samples and measures the light detected by sensing the light detecting node, and an external-brightness signal generator that generates the digital external-brightness signal based on a measurement output from the read circuit.

3. The display of claim 2, wherein the read circuit includes a first measuring circuit and a second measuring circuit, wherein the first measuring circuit is selectively enabled while the external-brightness detector operates in the first mode, and wherein the second measuring circuit is selectively enabled while the external-brightness detector operates in the second mode;

wherein the first measuring circuit measures the light of the light detecting node by measuring the voltage level of the light detecting node while selectively enabled; and wherein the second measuring circuit measures the light of the light detecting node by measuring the electric-current level of the light detecting node while selectively enabled.

4. The display of claim 2, wherein the read circuit includes:

a sensing node;

a first switch switchably connecting the light detecting node to the sensing node, a voltage sensor that compares the voltage level of the sensing node with a reference bias level and that outputs the comparison result as the measurement output of the read circuit; and a current-voltage converter switchably connected between the light detecting node and the sensing node by a second switch, the current-voltage converter varying the voltage level of the sensing node according to the electric-current level of the light detecting node.

5. The display of claim 1, further comprising:

the first photodetector, wherein the first photodetector includes:

a first photodiode that detects external light; and a first capacitor parallel-connected to the first photo diode;

and further comprising a reference photodetector that includes:

a first reference photodiode that detects reference light; and a first reference capacitor parallel-connected to the reference photo diode, wherein while operating in the first mode the external-brightness detector sequentially measures the voltage level of the light detecting node sequentially connected to the first photodiode and to the first reference photo diode.

6. The display of claim 1, wherein the second photodetector includes:

a second photo diode that detects external light; and a second reference photo diode serially-connected to the second photo diode wherein the second reference photo diode detects reference light, wherein while operating in the second mode the external-brightness detector measures the electric-current level of the light detecting node connected to the second photo diode and to the reference photodiode.

7. The display of claim 1, wherein the display panel is divided into a display area and a peripheral area, wherein the image is displayed in the display area and not in the peripheral area, and wherein at least one of the first and second photodetectors is formed in the peripheral area of the display panel.

8. The display of claim 1, wherein the brightness controller generates a brightness control signal based on a raw brightness signal and the digital external-brightness signal, and the display further comprises a light-emitting block supplying backlight of the display panel, and a backlight driver controlling the brightness of backlight according to the brightness control signal.

9. The display of claim 8, further comprising:

an image data signal processor that generates a converted image data signal based on a received image data signal; and a raw brightness signal generator that generates the raw brightness signal based on the received image data signal.

10. The display of claim 1, wherein if the brightness of the external light is high, the brightness controller increases the brightness of backlight, and if the brightness of the external light is low, the brightness controller decreases the brightness of backlight.

11. A driving device of a display comprising:

a brightness controller that controls the brightness of an image displayed on a display panel according to a digital external-brightness signal wherein the external-brightness signal is based upon measuring the analog voltage level of a light detecting node while operating in a first mode, and based upon measuring the analog electric-current level of the light detecting node while operating in a second mode.

12. The driving device of claim 11, further comprising:

an external-brightness detector that outputs the digital external-brightness signal and includes:

a first measuring circuit that outputs a digital measurement based upon measuring the voltage level of the light detecting node while enabled in the first mode;

a second measuring circuit that outputs a digital measurement based upon measuring the electric-current level of the light detecting node while enabled in the second mode; and an external-brightness signal generator that generates the digital external-brightness signal based on the digital measurement output from the currently enabled one of the first measuring circuit or the second measuring circuit.

13. The driving device of claim 12, wherein the first measuring circuit includes:

a first switch that switchably connects the light detecting node to the sensing input of the first measuring circuit, a voltage sensor that compares a voltage level of the sensing input of the first measuring circuit with a reference bias level and that outputs a comparison result as the digital measurement, and wherein the second measuring circuit includes the first measuring circuit and:

a current-voltage converter switchably connected between the light detecting node and the sensing input of the first measuring circuit, the current-voltage converter varying the voltage level of the sensing input of the first measuring circuit according to the electric-current level of the light detecting node.

14. The driving device of claim 12, wherein the digital external-brightness signal output by the external-brightness detector is a multi-bit value.

15. The driving device of claim 11, wherein the brightness controller generates the brightness control signal based on received image data and the digital external-brightness signal, and the display further comprises a light-emitting block supplying backlight of the display panel, and a backlight driver controlling the brightness of backlight according to the brightness control signal.

16. The driving device of claim 11, wherein if the brightness of the external light is high, the brightness controller increases the brightness of backlight, and if the brightness of the external light is low, the brightness controller decreases the brightness of backlight.

17. A driving method of a display comprising:

while operating in a first mode, measuring external-light detected by a first photodetector by measuring a voltage level of a light detecting node connected to the first photodetector and outputting a digital external-brightness signal based on the measurement and controlling the brightness of an image displayed on a display panel according to the digital external-brightness signal; and while operating in a second mode, measuring the external-light detected by a second photodetector by measuring an electric-current level of the light detecting node connected to the second photodetector and outputting the digital external-brightness signal based on the measurement and controlling the brightness of an image displayed on the display panel according to the digital external-brightness signal.

18. The driving method of claim 17, wherein the first photodetector includes:

a first external-light photodiode detecting external light; and a first capacitor parallel-connected to the first external-light photodiode;

and wherein a first reference photodetector includes:

a first reference photodiode detecting reference light;

a first reference capacitor parallel-connected to the first reference photodiode, wherein, while operating in the first mode, the outputting of the digital external-brightness signal comprises measuring the voltage level of the light detecting node sequentially connected to the first photodiode and to the first reference photodiode.

19. The driving method of claim 17, wherein the second photodetector includes:

a second photodiode detecting external light and connected to the light detecting node; and a second reference photo diode, serially-connected to the second photo diode, detecting the reference light and connected to the light detecting node, wherein, while operating in the second mode, the outputting of the digital external-brightness signal comprises measuring the electric-current level of the light detecting node.

20. The driving method of claim 17, wherein controlling the brightness of the image comprises increasing the brightness of backlight if the brightness of the external light is high, and decreasing the brightness of backlight if the brightness of the external light is low.

21. The driving method of claim 20, wherein the controlling of the brightness of the image comprises generating the brightness control signal based on a received image data signal and the digital external-brightness signal, and controlling the brightness of backlight of the display panel according to the brightness control signal.

22. The driving method of claim 17, wherein the digital external-brightness signal is a multi-bit value.

* * * * *